United States Patent [19]

Wallenbrock et al.

[11] Patent Number: 4,544,155

[45] Date of Patent: Oct. 1, 1985

[54] EXERCISE DEVICE WITH STRETCHABLE ELASTOMERIC LINE

[75] Inventors: Craig Wallenbrock, Arcadia, Calif.; Leroy R. Perry, Jr., 1301 E. Rubio, Altadena, Calif. 91001

[73] Assignee: Leroy R. Perry, Jr., Altadena, Calif.

[21] Appl. No.: 523,181

[22] Filed: Aug. 15, 1983

[51] Int. Cl.[4] ..... A63B 21/04

[52] U.S. Cl. ..... 272/136; 272/71; 272/137; 272/142; 272/143; 273/188 R

[58] Field of Search ..... 272/135–139, 272/142, 143, 116, 75, 76; 273/188 R

[56] References Cited

U.S. PATENT DOCUMENTS

| | | | |
|---|---|---|---|
| 418,257 | 12/1889 | Whitely . | |
| 623,698 | 4/1899 | Beckh | 272/75 |
| 2,498,006 | 2/1980 | Ridill . | |
| 3,618,942 | 11/1971 | Bates . | |
| 3,652,085 | 3/1972 | Cole . | |
| 3,677,543 | 7/1972 | Richardson . | |
| 3,807,730 | 4/1974 | Dalton et al. | 272/135 |
| 3,870,317 | 3/1975 | Wilson . | |
| 4,019,734 | 4/1977 | Lee et al. | 272/137 |
| 4,247,096 | 1/1981 | Schmitt | 272/143 X |
| 4,304,401 | 12/1981 | Goodman . | |
| 4,328,964 | 5/1982 | Walls . | |
| 4,340,218 | 7/1982 | Wilkinson . | |
| 4,411,423 | 10/1983 | Estwanik | 272/117 |

*Primary Examiner*—Robert A. Hafer
*Assistant Examiner*—Arnold W. Kramer
*Attorney, Agent, or Firm*—William W. Haefliger

[57] ABSTRACT

Exercise apparatus comprises (a) elongated, flexible, and yieldably stretchable elastomeric tubing, (b) first and second connections respectively attached to opposite end sections of said tubing, one of said connections connectible to a restraint, (c) and a harness attached to the second connection, the harness being flexible for releasable attachment to a portion of the human body, (d) whereby said body portion may be displaced in selected modes against resistance imposed by yieldable stretching of said tubing to controllably tension muscles associated with said body portion.

9 Claims, 14 Drawing Figures

EXERCISE DEVICE WITH STRETCHABLE ELASTOMERIC LINE

BACKGROUND OF THE INVENTION

This invention relates generally to exercise devices or apparatus, and more particularly relates to devices which enable strengthening of isolated or selected muscle regions or areas.

Prior devices commonly require users to grip the equipment with his or her hands, exerting force (as for example lifting) through the hands. This is undesirable from the stand point of isolated or selected arm muscle strengthening, since the muscles of the gripping hand are not then relaxed, and their tensioned condition influences the arm muscles. Also, prior devices employ bars or springs to exert movement resisting force; but such elements lack the advantageous characteristics of latex or elastomeric tubing employed by the present invention. Such desired characteristics include the imposition or creation of an even or more even resistance throughout the entire range of the exercise (arm, body or leg displacement).

SUMMARY OF THE INVENTION

It is a major object of the invention to provide apparatus enabling concentrated and isolated exercising of specific arm, leg or trunk areas of the body, without requiring transmission of resisting forces through the hands or feet, so that the latter are maintained relaxed during the exercise. This objective is met through the provision of an unusually advantageous harness that removably wraps about the wrist, forearm, elbow, trunk or legs so that area can be relaxed while other muscle groups can be worked to their fullest extent. In addition, the invention provides for even or near even resistance to arm, trunk or leg movement, through the use of elastic tubing which is flexible and yieldably stretchable, and non-injurious to clothing or body areas with which it comes in contact. A more complete workout of selected muscle groupings is thereby enabled.

Basically, the apparatus comprises:

(a) elongated, flexible, and yieldably stretchable elastomeric tubing, (b) first and second connections respectively attached to opposite end sections of said tubing, one of said connections connectible to a restraint, (c) a harness attached to the second connection, the harness being flexible for releasable attachment to a portion of the human body, (d) whereby said body portion may be displaced in selected modes against resistance imposed by yieldable stretching of said tubing to controllably tension muscles associated with said body portion.

As will appear, the harness comprise a flexible strip having an intermediate portion, the second connection attached to said intermediate portion. Further, the strip typically has opposite end portions adapted to be wrapped about said body portions and to overlap one another, and hook and pile means respectively on said opposite end portions to releasably interconnect in response to said overlapping. The use of an elastic tubing facilitates its connection to the harness and to a restraint, via hooks and rings to be described, with the tubing doubled back after passage through the rings, and joined to the main extent of the tubing, a very simple and effective assembly thus being provided.

These and other objects and advantages of the invention, as well as the details of an illustrative embodiment, will be more fully understood from the following specification and drawings, in which:

DRAWING DESCRIPTION

DETAILED DESCRIPTION

Figure 1:
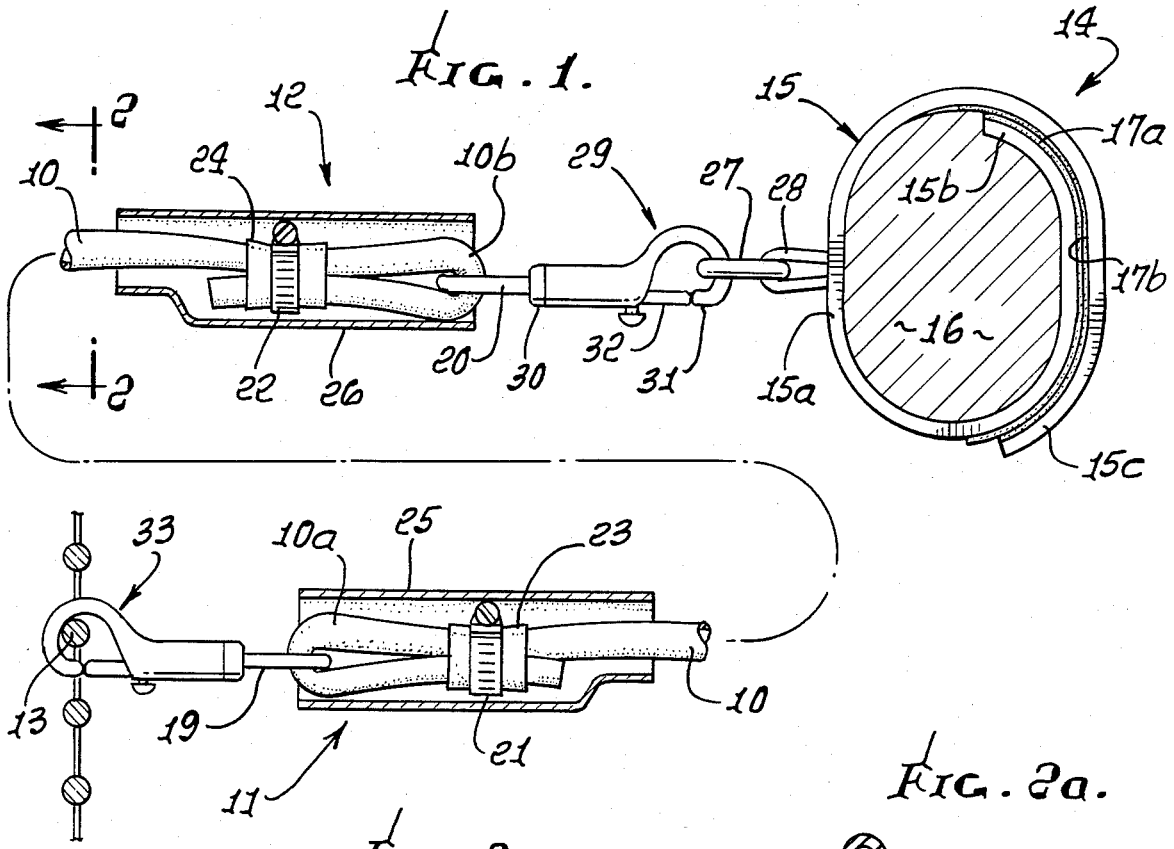
FIG. 1 is a side elevation showing exercise apparatus embodying the invention.

Referring first to FIG. 1, an elongated flexible and yieldably stretchable elastomeric tubing is provided at 10. It may with unusual advantage comprise surgical latex tubing, between about $\frac{1}{4}$ inch and $\frac{5}{8}$ inch in outside diameter when not stretched so as to be lightweight, smooth, flexible and yieldably stretchable to the most desirable extent in use, as will be described. Also, such tubing is easily storable as by winding in coil about or in association with harness to be described, and it does not tear clothing or harm the user as it rubs against his clothing or body, in use.

Associated with the tubing are first and second connections, generally designated at 11 and 12, respectively attached to opposite end sections of the tubing, connection 11 being attachable to a restraint such as a fence rod 13. A harness 14 is attached to the second connection. As will appear, the harness is flexible and releasaly attachable to a portion of the human body, whereby the latter may be displaced in selected modes against resistance imposed by yieldable stretching of the tubing to controllably tension muscles associated with that body portion (arms, legs, trunk, etc). Typically, the harness may comprise a flexible belt or strip 15 having an intermediate portion 15*a* to which the second connection 12 is attached.

Figure 9:
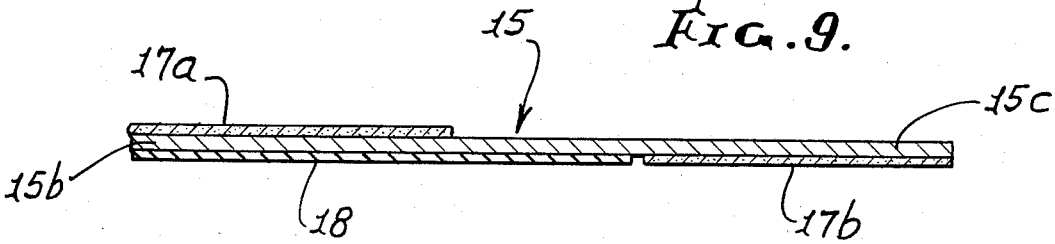
FIG. 9 is a modified form of wrap harness.

More specifically, the strip 15 typically has opposite end portions 15*b* and 15*c* adapted to be wrapped about the body portion (for example the wrist 16 shown in FIG. 1), and to overlap one another, as shown. Hook and pile (as for example VELCRO) means are on or associated with said end portions 15*b* and 15*c* to be releasably interconnected in response to overlapping or wrapping of the strip about the wrist or other body portion. See for example VELCRO layers 17*a* and 17*b* respectively attached to strip end portions 15*b* and 15*c*. Also, such VELCRO is easily released. The strip itself may consist of leather or as shown in FIG. 9, canvas, with an exposed layer of Neoprene 18 on the latter to assist in gripping the body.

More specifically, the tubing, connection and harness may have the following described unusually advantageous and simple construction. At least one of the connections includes a primary ring, one end section of the tubing passing through the ring and doubled back on itself, and a holder attaching that doubled back section to the main extent of the tubing. See for example, primary rings 19 and 20, first end section 10*a* of the tubing passing through ring 19 and doubled back on itself and held to the tubing 10 by holder 21; and second end section 10*b* passing through ring 20 and doubled back on itself and held to tubing 10 by holder 22. The holders may comprise tightenable clamps tightly clamping these elements, and protective sleeves 23 and 24 may be employed between the clamps and tubing. Protective leather or canvas smooth jackets 25 and 26 may loosely extend about these connections, as shown.

In addition, the second connector also includes a secondary ring 27 attached to the harness via fabric loop 28, and a hook 28 releasably attaching the ring 20 to ring 27. Hook 29 includes a base 30 rotatably attached to ring 20; a hooked end 31 protruding through ring 27; and a spring urged keeper 32 closing against hooked end 31. The first connection 11 is also shown to include a remote hook 33 attached to primary ring 19, that hook being attachable to restraint such as fence rod 13. Hook 33 has the same construction as hook 29.

Figure 2:
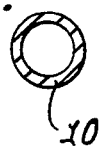
FIG. 2 is an enlarged section taken on lines 2—2 of FIG. 1.
Figure 2A:
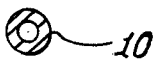
FIG. 2*a* is like FIG. 2.

FIG. 2 shows the main tubing cross section in unstretched condition; and FIG. 2*a* shows the same tubing cross section when stretched and tensioned.

Figure 3:
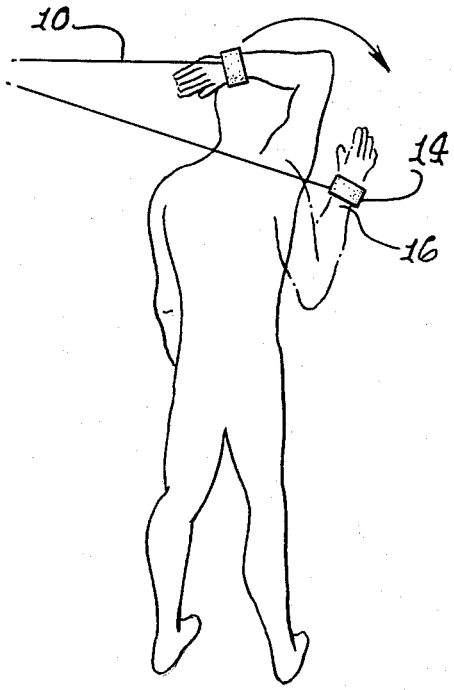
FIGS. 3–7 are diagrammatic views showing certain uses of the FIGS. 1 and 2 apparatus.
Figure 4:
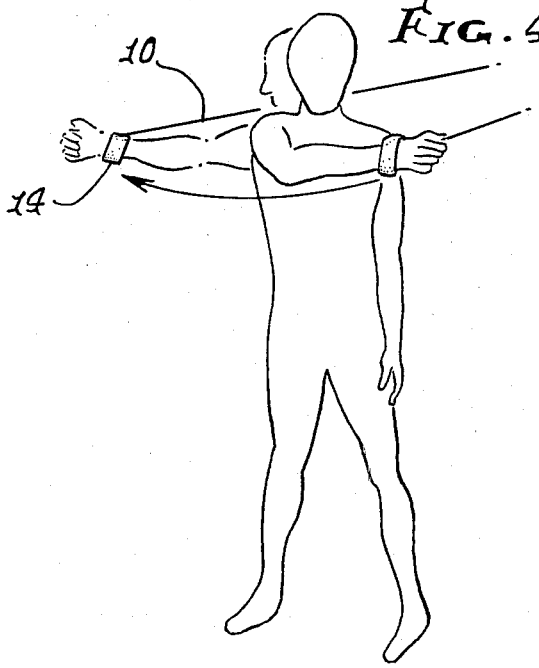

FIGS. 3–7 illustrate some of the many exercises enabled through use of the harness on the wrist, and in these views the arm and wrist are strengthened. In FIG. 3, the bent elbow adduction pull is shown. At first, the elbow is held above the head, the hand with palm facing the body and touching the shoulder, and the tubing 10 stretched some what. The elbow is then pulled down to the side while maintaining the bend. FIG. 4 shows the horizontal abduction exercise, facing sideways, with the elbow bent at a 135° angle and arm extended, the arm is pulled around to pull the stretched tubing across the chest.

Figure 5:
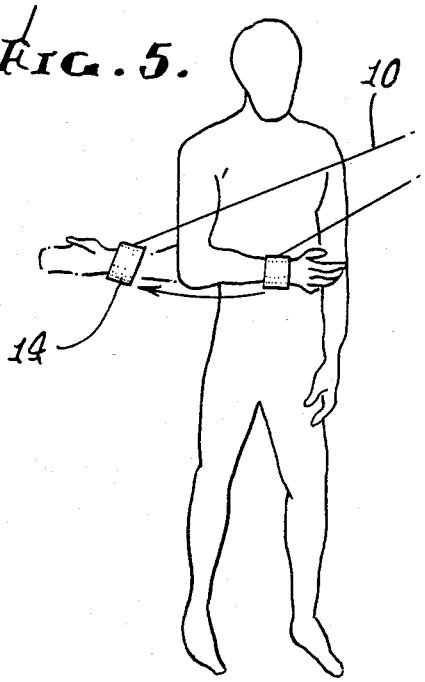
Figure 6:
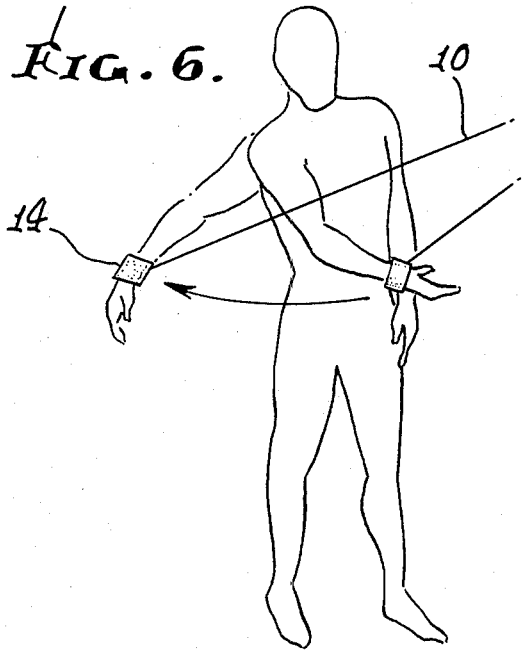

FIG. 5 illustrates external rotation from the flexed forearm position, while facing sideways. The elbow is placed firmly against the side, while bent at 90°. While holding the elbow firmly against the body, it is rotated away from the stomach as shown, the tubing tension increasing during such rotation. FIG. 6 shows abduction of arm (shoulder) while facing side ways. The elbow is first bent at 135°. While maintaining this angle, the hand is pulled sideways as shown, to increase the tension in the tubing.

Figure 7:
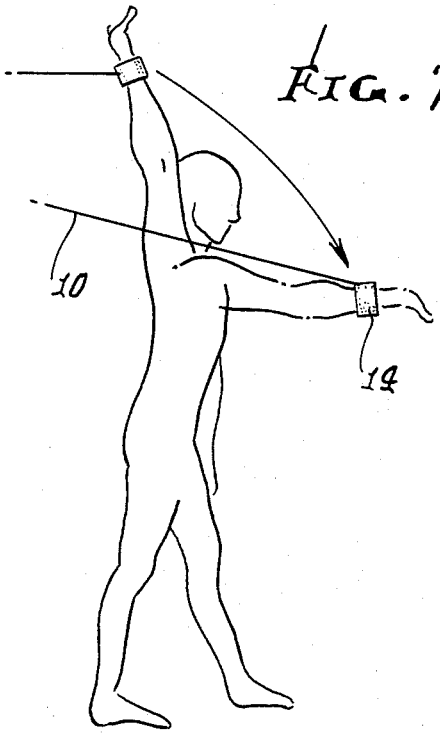

FIG. 7 shows a shoulder extension from a vertical arm position to a horizontal arm position, the person facing away from the restraint for the tubing, which is tensioned during such arm movement.

Figure 8:
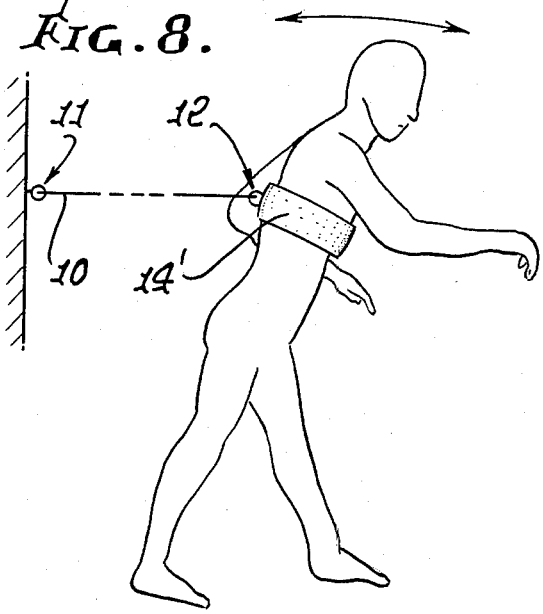
FIG. 8 is a diagrammatic showing use of a modified form of the FIG. 1 apparatus.

FIG. 8 shows a modified apparatus, wherein the tubing 10 and connections 11 and 12 remain the same. The harness 14' is like harness 14, but loner and wider so as to wrap about the user's torso as shown. He may then bend his torso forwardly against force imposed by the stretching tubing, and then return his torso to initial position. This exercise strengthens his stomach muscles. In similar manner, harness may be wrapped about the thighs and legs to enable leg muscle strengthening in response to leg movement acting to stretch tubing 10.

Figure 10:
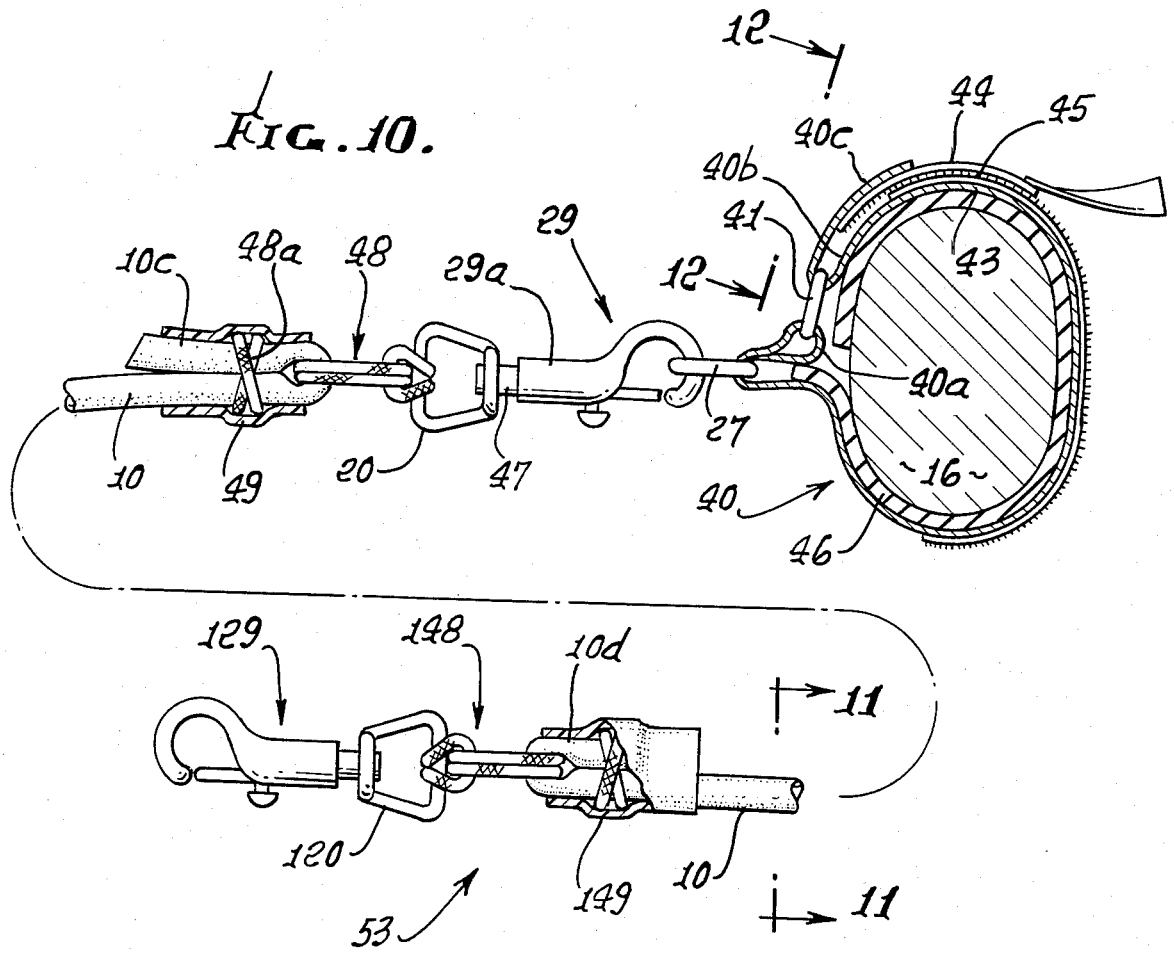
FIG. 10 is a view like FIG. 1, showing a further modification.

In FIG. 10, the harness comprises a flexible strip 40 having lengthwise spaced portions adapted to be wrapped about the body portion (wrist 16, or trunk, or arm, or leg, etc.), and to overlap one another. A plastic ring 41 is attached to one end portion of the strip which is looped about the ring at 40*a*. Another 40*b* of the strip spaced portions extends freely and adjustably through the ring 41 and is doubled back at 40*c* to overlap the strip. Hook and pile strips 43 and 44 are carried by the strip 40 and overlapping portion 40*c* to adjustably interengage, as at 45.

The strip 40 may consist of NYLON or other synthetic resinous sheet material, for high strength. A cushioning layer or strip 46 is secured to the strip 40, at its inner side, to wrap about body portion 16, and cushion the wrap attachment.

The hook connection 29 is like that in FIG. 1, and has corresponding elements, including a primary ring 20 pivoted at 47 to the hook body 29*a*. One end section of the elastomeric tubing 10 is doubled back on itself at 10*c*, and a high strength cord 48 (NYLON or the like) is passed through ring 20 and tied at 48*a* about the doubled back tubing end section.

Figure 11:
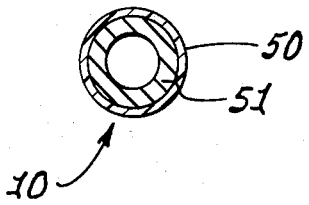
FIG. 11 is a section on lines 11—11 of FIG. 10.
Figure 12:
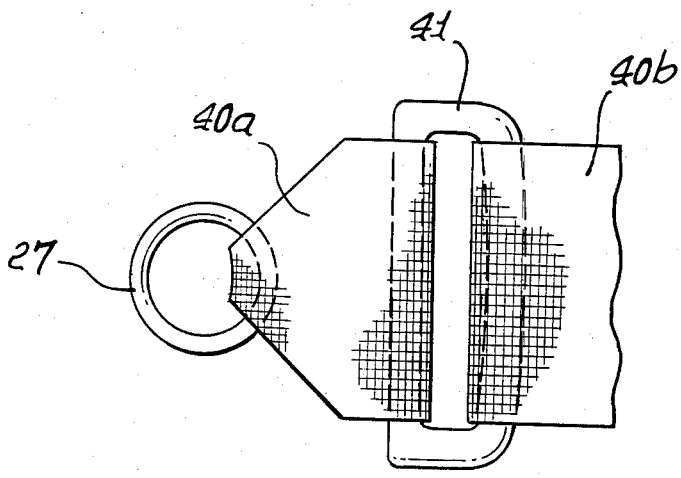
FIG. 12 is a view on lines 12—12 of FIG. 10.

A latex skin shroud 49 may be shrunk about the doubled back tubing, as shown. Also a colored latex skin 50 may be formed about the tubing core 51, as shown in FIG. 11.

The connection 53 at the opposite end of the tubing may have a similar construction, as shown. See corresponding elements 129, 120, 148, 149 and 10*d*.

Figure 13:
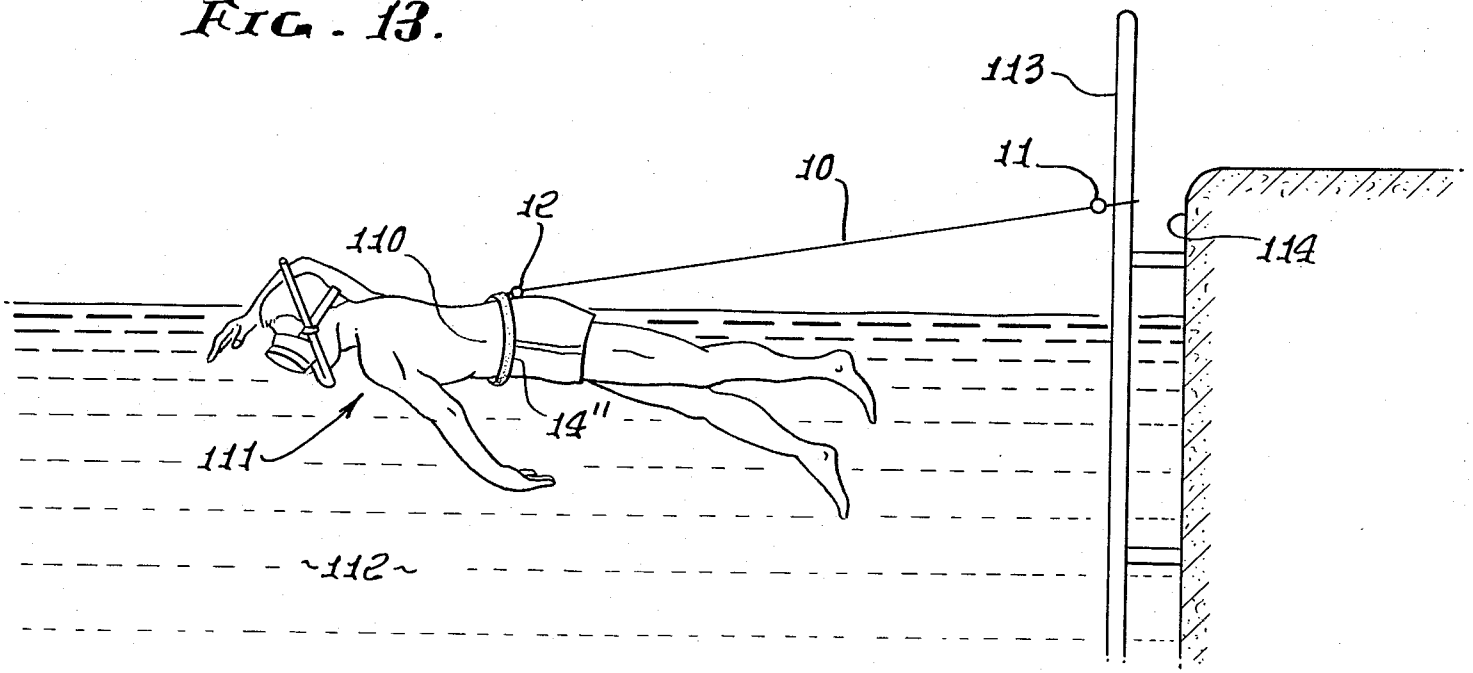
FIG. 13 is a side elevation showing use of the apparatus.

FIG. 13 illustrates use of a harness 14'', similar to that shown at 14' in FIG. 8, wrapping about trunk 110 of a swimmer 111 in pool 112. Tubing 10 and connections 11 and 12 remain the same. The swimmer is enabled to use, therapeutically, all of his swimming muscles (arm, leg and torso), yet he remains restrained by stretching of tubing 10. Therefore, he does not need to frequently turn and reverse direction that connection 12 is at the swimmer's lower back, so as not to interfere with leg and arm movement. Connection 11 attaches to pool structure such as ladder 113, or the pool sidewall 114. In this regard, the apparatus is adapted to underwater use to enable positive synergistic and iso-kinetic resistance. Further, the apparatus enables use of any swimming pool as a training center, since it not only produces resistance, but allows the swimmer/patient to concentrate on body motion and coordinated activity to ensure neuromuscular coordination within a defined or limited area.

Additional uses of the apparatus include the following exercises pulling against the resistance of the elastmeric tube:

(a) with the strap wrapped about the user's wrist: bicep curls; tricep curls; latissumus dorsi, anterior and posterior; throwing motion; arm swimming motion; shoulder shrugs; bilateral bicep curls; underhand and arm press.

(b) with the strap wrapped about the user's upper head: anterior neck flexor; posterior neck extensor; lateral neck flexor; and full flexor.

(c) with the strap wrapped about the user's thigh: hamstring extension; full extension; adduction set, anterior and posterior; quadricep flexor; guadricep full flexion; hip and thigh full adduction.

(d) with the strap wrapped about the shoe or foot: quadricep extensors; gastronemius flexion and hamstring extension; full extension; full anterior adduction of entire leg and foreleg; full posterior adduction of entire leg and foreleg.

(e) with strap wrapped about the user's waist, he may push forewardly, with running leg movement.

(f) with strap wrapped about the user's chest, he may perform 30 degree situps.

(g) with strap and tubing wrapped about user's upper legs, in sitting position, he may move his legs apart and together, against tube resistance.

I claim:

1. Exercise apparatus, comprising (a) an elongated, flexible, and yieldable stretchable elastomeric means having opposite ends, (b) each end of said means being folded back upon itself so as to form a loop, (c) two elongated flexible members, one at each said end, each member folded back on itself to define strands having the free ends thereof fastening the free end of the folded back portion of the elastomeric means so as to secure said loop formation and with the strands passing therethrough, (d) each loop of the flexible members so formed being looped through a respective ring of a pivoting snap hook, (e) and harness means in the form of a belt, said belt being folded back on itself with the folded back portion having loop means formed therewith, one free end of the belt having ring means with the other free end looped through the ring means and folded back on itself to be fastened by fastening means whereby the belt can be placed around different sized body members and adjustably fastened thereto by said fastening means and the loop means on said belt being releasably joined to either snap hook, with the other snap hook being releasably joined as desired to any exterior support structure.

2. The apparatus of claim 1 wherein said belt comprises leather or imitation leather.

3. The apparatus of claim 1 wherein said belt comprises canvas or the like, and including a Neoprene layer thereon.

4. The apparatus of claim 1 wherein said stretchable elastomeric means comprising tubing.

5. The apparatus of claim 4 including a restraint to which one hook is connected, said tubing being tensioned into stretched condition, and characterized by a reduced diameter of main extent of the tubing.

6. The apparatus of claim 4 wherein said members defining said strands comprise cords.

7. The apparatus of claim 6 including a latex skin shround extending about said one end section of the tubing and the cord tying same.

8. The apparatus of claim 4 including a colored latex skin surrounding the tubing.

9. The apparatus of claim 1 wherein said belt comprises NYLON or the like, and including a cushion layer at the inner side of said belt to wrap with said belt about said body member.

* * * * *